United States Patent [19]

Wigmore et al.

[11] Patent Number: 4,932,467

[45] Date of Patent: Jun. 12, 1990

[54] MULTI-CHANNEL HEAT EXCHANGER WITH UNIFORM FLOW DISTRIBUTION

[75] Inventors: David B. Wigmore; Bradley A. Dobbs, both of San Diego, Calif.

[73] Assignee: Sundstrand Corporation, Rockford, Ill.

[21] Appl. No.: 258,467

[22] Filed: Oct. 17, 1988

[51] Int. Cl.[5] ..... F28F 27/00; F28D 9/04

[52] U.S. Cl. ..... 165/96; 165/163; 165/166

[58] Field of Search ..... 165/96, 152, 163, 166, 165/167, 174

[56] References Cited

U.S. PATENT DOCUMENTS

| | | | |
|---|---|---|---|
| 2,143,565 | 1/1939 | Minea | 137/601 |
| 2,212,748 | 8/1940 | Parker | 62/216 |
| 2,261,596 | 11/1941 | Stroobants | 165/96 |
| 3,058,722 | 10/1962 | Rich | 165/156 |
| 4,270,602 | 6/1981 | Foster | 165/167 |

FOREIGN PATENT DOCUMENTS

| | | | |
|---|---|---|---|
| 115938 | 3/1946 | Sweden | 165/166 |
| 6498 | of 1885 | United Kingdom | 165/166 |

OTHER PUBLICATIONS

U.S. patent application Ser. No. 221,803, filed Jul. 20, 1988, Dobbs et al.

*Primary Examiner*—Martin P. Schwadron
*Assistant Examiner*—Allen J. Flanigan
*Attorney, Agent, or Firm*—Wood, Phillips, Mason, Recktenwald & VanSanten

[57] ABSTRACT

A heat exchanger includes a plurality of generally planar spiral flow channels in a stacked, generally parallel array for accommodating a first fluid. Each spiral flow channel terminates in an inner end at an axial core area of the heat exchanger. Flow channels are sandwiched between the spiral flow channels for accommodating a second fluid in heat exchange relationship with the first fluid. Relatively rotatable tubes extend axially of the core area and have radial openings in axial registry with the inner ends of the spiral flow channels. Relative rotation of the tubes vary the overlapping relationship of the tube openings and thereby vary the flow to the spiral flow channels.

1 Claim, 3 Drawing Sheets

MULTI-CHANNEL HEAT EXCHANGER WITH UNIFORM FLOW DISTRIBUTION

FIELD OF THE INVENTION

This invention generally relates to the art of heat exchangers and, particularly, to a heat exchanger combination of spiral flow channels with a centrally located common expansion valve for use at all attitudes and gravity levels.

BACKGROUND OF THE INVENTION

Heat exchangers are used for a wide variety of applications; for instance, in refrigeration cycle evaporators and the like. When heat exchangers are required to process two-phase fluids, special design considerations must be taken to ensure satisfactory operation in an all-gravity environment.

For instance, multiple spiral flow channels separated by suitable channels for the heat sink or heat source fluid may be used to effect a compact, lightweight, economic design. In some instances, a two-phase fluid might enter and leave from the outside of the spirals. This is effected by reversing the inner moving spiral flow channel near its center and forming an outer moving spiral channel such that there is, in effect, two spirals running counter to each other in the same plane.

The reversing spiral concept, while possessing considerable utility for applications where little temperature change of a two-phase flow is anticipated, may perform adversely in other situations. For instance, at the center of the spiral where the fluid changes radial direction, the secondary flow pattern which is fundamental to establishing annular flow, will be disturbed and control of the liquid film may be lost. Due to the confined space for spiral reversal, a pressure drop gradient will be accompanied by a temperature drop. This temperature difference between adjacent spiral passages, in addition to any associated with the presence of superheated vapor or subcooled liquid, will cause undesirable heat transfer between two-phase fluid streams in the radial direction.

In addition, if an all-gravity vapor compression refrigeration cycle evaporator of two-phase flow is desired, it not only is necessary to address the heat exchanger design, but it also is necessary to ensure uniform distribution of the fluid to each of the multiple spiral channels. Using just any approach to throttling the liquid refrigerant across an expansion valve to a low quality two-phase condition before delivering it to the heat exchanger, will subject the fluid to gravity forces which will tend to separate the liquid and vapor phases. By low quality is meant a high liquid content. The liquid will be forced in the direction of the gravity vector such that, under some conditions, a number of flow channels will be fed saturated liquid refrigerant while the majority of the flow channels will be supplied with saturated vapor.

This invention is directed to providing a compact core, multiple spiral flow evaporator or heat exchanger with a centrally located integral expansion valve where the fluid (liquid refrigerant) is introduced axially at the center and flows as a two-phase fluid in a spiral pattern to the outside. The invention ensures uniform distribution to each flow channel at all attitudes and "g" levels while alleviating the problems which may be encountered with a reverse spiral flow approach.

SUMMARY OF THE INVENTION

An object, therefore, of the invention is to provide a novel heat exchanger combination of a multiple spiral flow path with a centrally located all-gravity distribution valve.

Generally, the invention contemplates a heat exchanger having a plurality of spiral flow channels for accommodating a fluid, with each channel terminating in an inner end at an axial core of the heat exchanger. Valve means extend axially of the core and in communication with the inner ends of the spiral flow channels for distributing the fluid to all of the flow channels from a single source.

More particularly, a heat exchanger is disclosed herein for an all-gravity vapor compression refrigeration cycle evaporator application. A plurality of generally planar spiral flow channels are stacked in a generally parallel array for accommodating a first fluid, with each spiral flow channel terminating in an inner end at an axial core of the heat exchanger. Flow channel means are sandwiched between the planar spiral flow channels for accommodating a second fluid in heat exchange relationship with the first fluid. Valve means are provided in the form of a pair of co-axial tubes with respective radial openings movable into and out of registry in response to rotation of one of the tubes for varying the flow of the first fluid to the inner ends of the spiral flow channels.

As disclosed herein, the valve means include a stationary, axially extending interface tube having radial openings in registry with the inner ends of the spiral flow channels. A distribution tube is co-axially disposed within the interface tube and has openings in registry with the openings in the interface tube. Means are provided for rotating the inner tube to vary the overlapping relationship of the tube openings and thereby varying the flow of the first fluid to the spiral flow channels.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
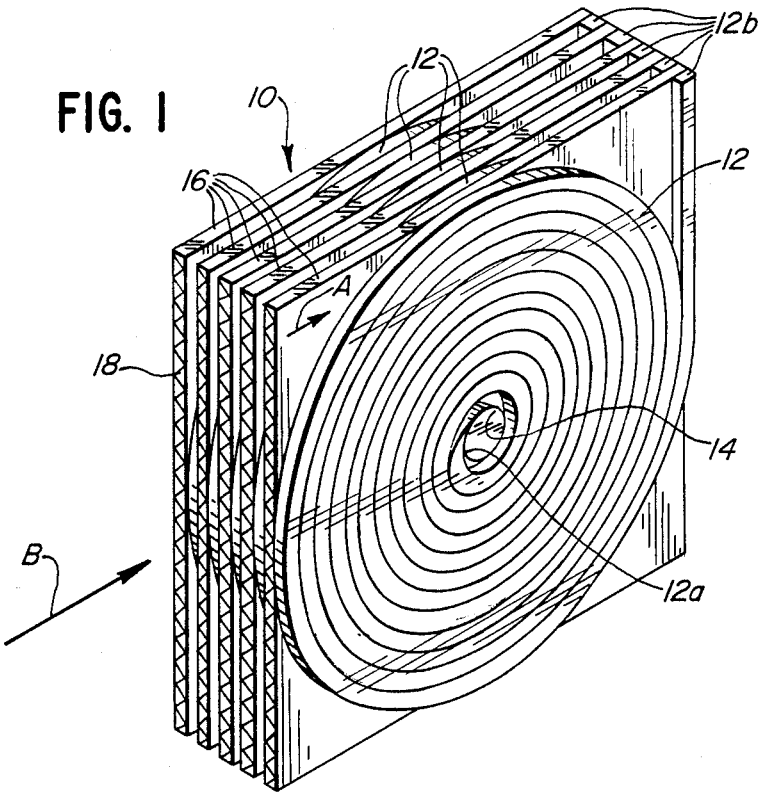
FIG. 1 is a perspective view of a heat exchanger construction incorporating the concepts of the invention.

Referring to the drawings in greater detail, and first to FIG. 1, a heat exchanger unit, generally designated 10, is illustrated and includes a plurality of spiral flow channels 12. It can be seen that each spiral flow channel is generally planar and includes an inner open end 12*a* and an outer open end 12*b*. The inner ends, in essence, are located in an axial core area 14 of the unit. As shown, spiral flow channels 12 are arranged in a stacked, generally parallel array for accommodating a first fluid.

The spiral flow channels 12 may be constructed of stamped fins, machined plate or tubes. The flow passage design may be of square, rectangular, triangular or any other convenient-to-manufacture cross-section. The cross-sectional area of each spiral channel may be constant or variable depending on the velocity requirement in the channels. The heat sink fluid, typically condensed liquid in a vapor cycle application, enters the spirals axially through inner ends 12*a* and is controlled by an expansion valve described hereinafter.

Generally planar flow channel means 16 are alternatingly sandwiched between spiral flow channels 12 for accommodating a second fluid in heat exchange relationship with the first fluid in the spiral channels. Each flow channel means 16 includes a plurality of flow passages, as by a planar panel construction, as shown, with interior corrugations 18 defining linear flow paths extending through the panels, as indicated by arrow "A". Therefore, the second fluid passes through panels 16 generally parallel to the spiral flow channels, but substantially crossing the direction of flow through a substantial portion of the spiral configuration. Of course the second fluid need not necessarily make only one pass across the heat exchanger. It could, for example, flow in one half and reverse flow out the second half; i.e., it could enter and return from the same side of the heat exchanger.

Figure 2:
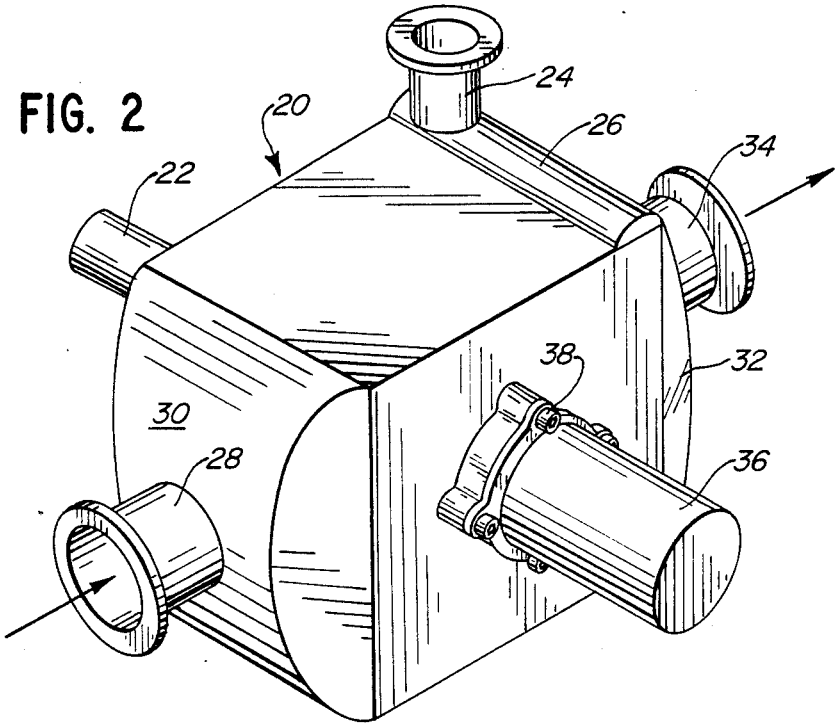
FIG. 2 is a fragmented perspective view of the exterior of a heat exchanger casing and inlet and outlet ports, for housing the heat exchanger construction and valve means.

FIG. 2 shows the exterior of an appropriate casing, generally designated 20, for housing the heat exchanger unit 10 described in relation to FIG. 1. The first fluid, such as the heat sink fluid or condensed liquid in a vapor cycle application, enters one side of casing 20, as through port 22, and, through valve means described hereinafter, is distributed to the inner ends 12*a* (FIG. 1) of the spiral flow passages. Vapor exits casing 20 through an outlet port 24 in communication, through a manifold 26, with outer ends 12*b* (FIG. 1) of spiral flow channels 12. The second or heat source fluid enters casing 20 through an inlet port 28 and, by means of a manifold 30, flows into the passages of flow channel panels 16, as indicated by arrow "B" in FIG. 1. The heat source fluid exits casing 20 through a manifold 32 and an outlet port 34. A control valve drive motor 36 is appropriately fastened, as at 38, to casing 20 on the opposite side of inlet port 22 for the condensed liquid of the vapor cycle evaporator, as described below.

Figure 3:
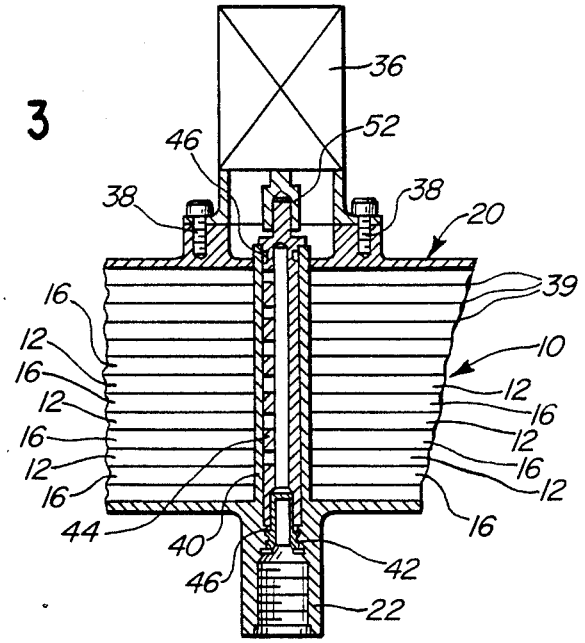
FIG. 3 is an axial section through the heat exchanger construction and valve combination.

FIG. 3 shows a fragmented, sectional view through casing 20 and the heat exchanger unit 10 mounted therewithin. Shown within casing 20 are spiral flow channels 12 alternating with and sandwiched between flow channel panels 16. Each are separated by plain sheets 39. Inlet port 22 and drive motor 36, with fastening means 38, also are shown for correlation with FIG. 2. In a typical vapor cycle system, liquid refrigerant is fed into port 22 and to an interface tube 40 which is formed integral with casing 20 and extending axially through core area 14 (FIG. 1) of heat exchanger unit 10. The liquid refrigerant is fed to interface tube 40 through a standard pipe fitting or braze connection, into a transfer tube 42 and then into a distribution tube 44. The distribution tube extends telescopingly, axially within interface tube 40. Appropriate seals, such as O-rings 46, are provided between the tubes generally at opposite ends of heat exchanger unit 10.

Figure 4:
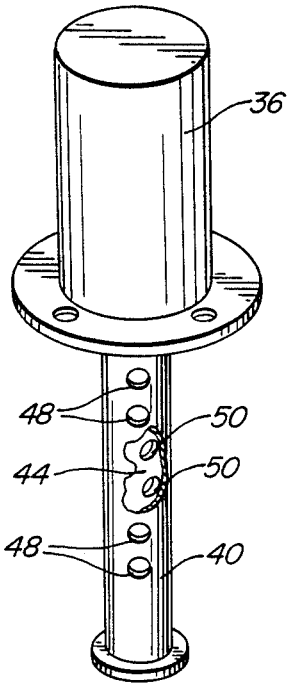
FIG. 4 is a perspective view of the valve means, partially cut away to illustrate the registerable openings in the tubes thereof.

Referring to FIG. 4 in conjunction with FIG. 3, interface tube 40 has a plurality of radial openings 48 which are located in axial registry with the inner ends 12*a* (FIG. 1) of spiral flow channels 12. Inner distribution tube 44 has a plurality of radial openings 50 in axial registry with openings 48 in interface tube 40. Drive motor 36 is coupled, as at 52 (FIG. 3), to distribution tube 44 for rotating the distribution tube within and relative to stationary interface tube 40. The drive motor may be an electrically driven stepper motor with a gear head, a pneumatically (refrigerant gas) actuated device, or other device depending on the application.

The above described structure and operation of interface tube 40, distribution tube 44 and drive motor 36 set forth an expansion valve means which evenly distributes the incoming fluid to the plurality of spiral flow channels 12 regardless of attitude, i.e. all gravity. The flow of fluid is controlled by relatively rotating the tubes, (in this instance, rotating distribution tube 44) to vary the overlapping relationship of openings 48 and 50 and thereby varying the flow of fluid to spiral flow channels 12. The fluid is introduced to the valve as a liquid and expands to a liquid-vapor mixture across the radial holes in the co-axial tubes. Since these holes are in intimate communication with the spiral passages of the heat exchanger, there is no opportunity for the vapor and liquid phases to become separated and mal-distribute between such spiral passages. This is the essential feature for assurance of uniform two phase flow.

Figure 5:
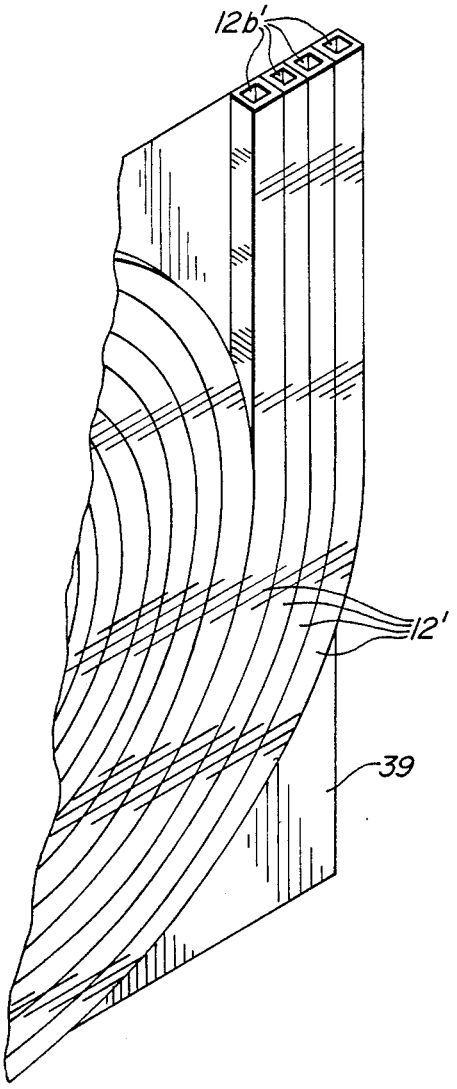
FIG. 5 shows a fragmented view of an alternate form spiral flow channel means with multiple co-planar spiral channels.

FIG. 5 shows a fragmentation of an alternate form of spiral flow channel means with multiple, co-planar spiral channels 12'. These spiral channels are spirally interleaved with each other and have separate outer ends 12*b'* for communication with an appropriate manifold. As with FIGS. 1–4, these sets of interleaved spiral flow channels would alternate with or be sandwiched between flow channel panels 16. All are separated by plain sheets 39. The inner ends of the interleaved channels are not shown but could be located 90 degrees apart and spaced around the outer cylindrical surface of an interface tube (like tube 40, FIG. 4) with four holes (48) spaced 90 degrees apart. A complementary distribution tube (44) likewise would have four holes (50) spaced 90 degrees apart.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A heat exchanger, comprising:

means defining a plurality of generally planar spiral flow channels in a stacked, generally parallel array for accommodating a first fluid, each spiral flow channel terminating in an outer end at a periphery of the heat exchanger and an inner end at an axial core area of the heat exchanger;

means defining a plurality of generally planar linear flow channels sandwiched between the spiral flow channels for accommodating a second fluid in heat exchange relationship with the first fluid, each linear flow channel having inner and outer ends at opposite peripheral sides of the means defining the spiral flow channels;

valve means extending axially of the core area and in communication with said inner ends of the spiral flow channels for distributing the first fluid to all the flow channels from a single source, the valve means including an axially extending, stationary interface tube forming a common wall at the inner ends of the spiral flow channels, the common wall having radial openings in axial registery and fluid communication with the inner ends of the spiral flow channels, and a rotatable distribution tube telescopingly disposed within the interface tube and having radial openings in axial registry with the openings in the interface tube; and means for rotating the distribution tube within the interface tube to vary the overlapping relationship of the tube openings and thereby varying the flow of the first fluid to the spiral flow channels.

* * * * *